United States Patent [19]

Shavit

[11] 4,394,936

[45] Jul. 26, 1983

[54] DEFORMABLE CONTAINER AND A FLAT PIECE FOR MAKING A CONTAINER

[76] Inventor: Henri Shavit, General Guisanstrasse 1, 4144 Arlesheim, Switzerland

[21] Appl. No.: 270,988

[22] Filed: Oct. 14, 1981

[51] Int. Cl.[3] ..... B65D 35/08; B65D 35/14

[52] U.S. Cl. ..... 222/107; 222/92; 428/36; 428/35

[58] Field of Search ..... 222/92, 107, 206, 215; 428/36, 35

[56] References Cited

U.S. PATENT DOCUMENTS

| | | | |
|---|---|---|---|
| 2,947,653 | 8/1960 | Föhr | 222/107 |
| 3,128,913 | 4/1964 | Specketer | 222/107 |
| 3,258,169 | 6/1966 | Paisley | 222/107 |
| 3,338,475 | 8/1967 | Englesson | 222/107 |
| 4,090,541 | 5/1978 | Cammarata et al. | 222/107 |

FOREIGN PATENT DOCUMENTS

| | | |
|---|---|---|
| 603423 | 8/1978 | Switzerland . |
| 610259 | 12/1979 | Switzerland . |

*Primary Examiner*—William R. Dixon, Jr.
*Attorney, Agent, or Firm*—Daniel H. Bobis

[57] ABSTRACT

A first work piece for forming a tube body (3) made of a carton blank which is coated with a fuseable plastic material on one side and which is provided with an opening in the center thereof. In this opening, a second work piece is inserted and fused having a socket and a collar for forming a discharge opening (7). Thereafter, the blank is folded in such a manner that two walls (3*a*) are generated which are connected with a center segment (3*d*) having a lens shaped contour containing the discharge opening (7). Thereafter, the side edges of the walls (3*a*) are fused with each other in pairs, but the end of the tube body (3) facing away from the discharge opening (7) remains open. Subsequently, filler material is filled through the opening and thereafter the edges (3*c*) of the wall facing the discharge opening (7) are also fused. In this manner, tube like containers can be made, which can be also closed at the discharge end by the first work piece which consists of comparable inexpensive material.

9 Claims, 17 Drawing Figures

DEFORMABLE CONTAINER AND A FLAT PIECE FOR MAKING A CONTAINER

Figure 1:
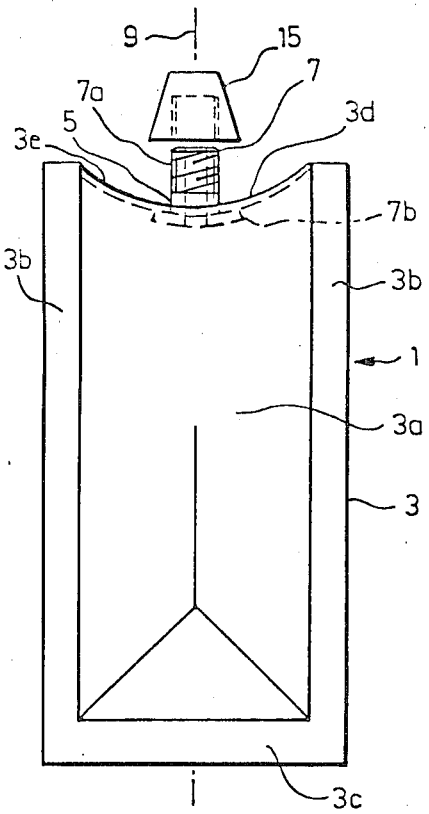

This invention relates to a deformable container and a flat piece for making a container.

Known tubes with a closable discharge opening generally consist of a cylindrical aluminum container which is provided at one end with a light cone shaped front face and a discharge socket. The latter is provided with a thread and is closable by means of a screw cap. When making the tubes, the end opposite the discharge opening remains open. When filling the tubes, the filler material is filled through the open end and is closed after the filling operation.

Since the aluminum tubes and the filler material to be filled therein are generally made in different manufacturing plants, the empty tubes must be transported from the tube manufacturer to the plant which performs the filling of the tubes. Therefore, the transport and the storing of the empty substantially cylindrical tubes require large transport and storage spaces which unfavorably influence the economy. Furthermore, during the storage and the transporting of the empty tubes which are open at one end, it is practically unavoidable that impurities, like dust, can enter into the empty tubes. This requires, in many cases, expensive cleaning and sterilization operations. Since the tubes are generally provided with some kind of printing, a further disadvantage consists of that the print must be applied onto a cylindrical face which is relatively expensive. Furthermore, in particular with smaller tubes, not enough space is available for printing all the required or essential information thereon, for using the filler material. When the tube is partially emptied and compressed flat, or is rolled up from its rear end, the print thereon can hardly be read or cannot be read at all.

Furthermore, tubes made of plastic material are known, whereby the cylindrical tube jacket has such an elasticity that it again resumes its original shape, after expelling the filler material. This assures that the print on the tube is still very legible, even if the tube is substantially emptied. However, the mentioned elasticity and nondeformability of this tube permits air to be aspirated into the tube, after expelling the filler material, due to the subject reexpansion of the tube. The tubes made of plastic material have partially similar disadvantages as described before with respect to the aluminum tubes.

From the Swiss Patent No. 610 259 tubes are known which have a type body and a head portion connected therewith. The tube body is provided with two walls consisting of carton material which is coated on the inside with fusable plastic material. Both of these walls are connected with each other at a side edge by means of a folding edge and are fused with each other at their two side edges and the edge facing away from the head portion. The head portion is provided with a discharge socket with an outer thread, whereby a shoulder portion is provided on the back side end adjacent to the socket consisting of a conical and a radial shoulder segment. A flange is tip stretched onto the circumference of the shoulder portion which is provided with a segment extending cylindrically and coaxially to the discharge socket away from the shoulder portion and away from the inner space of the tube. A radially outwardly extending collar is provided adjacent to this segment. The head portion may consist of plastic material and may be fused with the tube body. In the tube known from the Swiss Patent No. 610 259 the tube bodies and the head portions are made separately, whereby the tube bodies remain open at their head ends and are fused together at their remaining edges. After the tubes are finished, the tube bodies and the head portions are separately stored and separately fed to the filling station. The walls of the tube bodies are flat in a superimposed position during storage and during transport, and are only spaced apart during the filling with filling material. When a tube body is filled, a head portion is then inserted into its open end and fused with the tube body.

The tubes made from Swiss Patent No. 610 259 have the disadvantage that the head portions which preferably consist of fusible plastic material must extend across the total cross section of the head side end of the tube body. So that the head portions can be fused with the filled tube body, they must also be provided with the aforementioned flange. Since the head portions consist of a relatively expensive plastic material, the manufacturing of the tubes is considerably mor expensive due to the head portions. This expense is very apparent when making tubes with large cross sectional dimensions. Furthermore, the complicated shape of the head portions considerably increases the manufacturing costs. In order to obtain a tight connection between the head portion and the tube body during fusing, the flanges of the head portions must be exactly fitted into the open ends of the tube bodies, which also increases the manufacturing costs. Furthermore, the fusing of the head portions onto the tube bodies requires complicated and expensive devices and operating steps. So as to generate the required pressure for the fusing operation, the annular like flange and the edge of the tube body must be pressed toward each other from both sides with tools. So that at least a portion of the air, which is present above the filler material in the tube, can escape during the insertion of the head portion flange, it is practically a must to first close the discharge socket of the tube body, after the head portion is mounted on the tube body. This completes the filling method. Furthermore, it is unavoidable that a certain amount of air remains in the tube which is damaging to certain filler materials. Furthermore, it is difficult to avoid impurities getting into the tube when inserting and mounting the head portion. A further disadvantage consists in that expelled material and other impurities can collect on the outside of the head portion in the annular groove which is limited by the shoulder portion and the flange when using the tube.

From Swiss Patent No. 603 423 tubes are made having a substantially rectangular contour onto which a soft flat work piece is fused forming the tube body during the manufacturing operation and onto which a later formed discharged opening is fused forming the front face of the tube. Thereby, the flat like work piece is folded in such a manner, before or after the forming of the discharge opening, that the two walls of the tube are connected at the front face and are limited from each other by a folding edge. This folding edge, or more precisely expressed, the segments at both sides of the discharge opening extends in an even integer which crosses the discharge of the tube axis. Furthermore, the flat work piece is fused at the edges which later form the side edges and the edge of the tube body facing away from the discharge opening. Furthermore, the zones are fused with each other which are present on the different sides of the discharge opening in the mentioned folding edge at which the two walls are connected with each other.

Therefore, in the known tubes of Swiss Patent No. 603 423, the two tube walls do not only engage at the two side edges and at the edge facing away from the discharge opening, but also on a portion of the front face. When the tube is empty, the two straight walls are only separated in the center of the front face by the discharge opening. Since the walls consist of a of a soft and flaccid material they engage with each other in all areas when the tubes are empty. Therefore, no free hollow space is available before the filling process. The two walls are only pushed apart by the filler material. Therefore, the tube does not have a defined volume, which is disadvantages for many applications. When the tube contains a paste-like filler material with a low viscosity, the filler material can run out of the tube if the tube is left open on a table or the like, without being manually compressed.

It is therefore an object of the invention to provide a method for making a deformable container which overcomes disadvantages of the prior art such as elastic resiliency or tendency toward self-collapse. Thereby, the container should be compressible for pressing out the filler material, but it should also have a certain form rigidity, so that its walls already form a hollow space before filling the filler material, so that the walls do not collapse on their own.

Accordingly, it is the principal object of the present invention to provide a deformable container having a tubular body formed of a unitary first work piece of foldable semi-rigid uniformly thick sheet material and a second work piece and closing lid in cooperation therewith fusibly fitted to an opening in the tubular body for controllably dispensing the filler material contained therein.

It is another object of the present invention to provide a container having a front face of defined shape transverse to the lengthwise side walls of the container capable of preventing the collapse of the mating side walls and closure of the hollow space therein during controlled dispensing of the filler material contained in the tubular body.

It is another object of the present invention to provide a deformable container constructed of sheet material which can be easily printed upon by economical graphic arts processes prior to foldable manipulation into a tubular body.

Other objects and advantages of the present invention will become apparent from the following description taken in conjunction with accompanying drawings showing several embodiments.

The invention will now be explained in conjunction with the embodiments shown in the drawings. The drawings show in:

FIG. 1 a plan view on the broad side of a tube like container and separately therefrom the closing lid.

Figure 2:
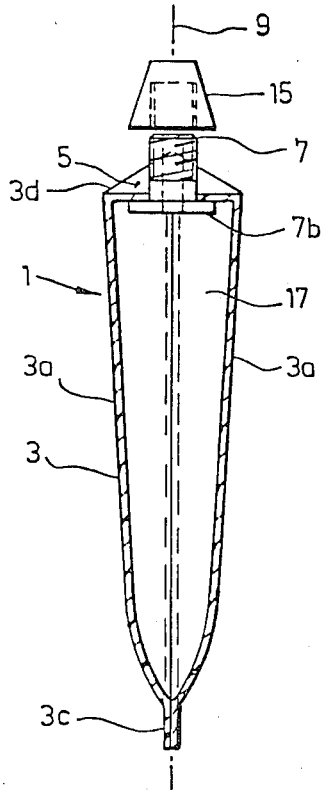
Figure 3:
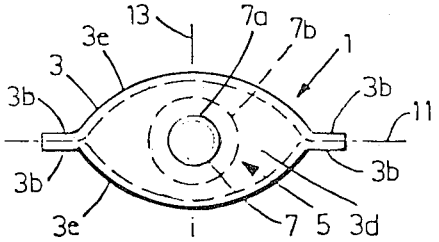
Figure 5:
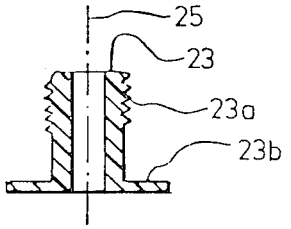
Figure 4:
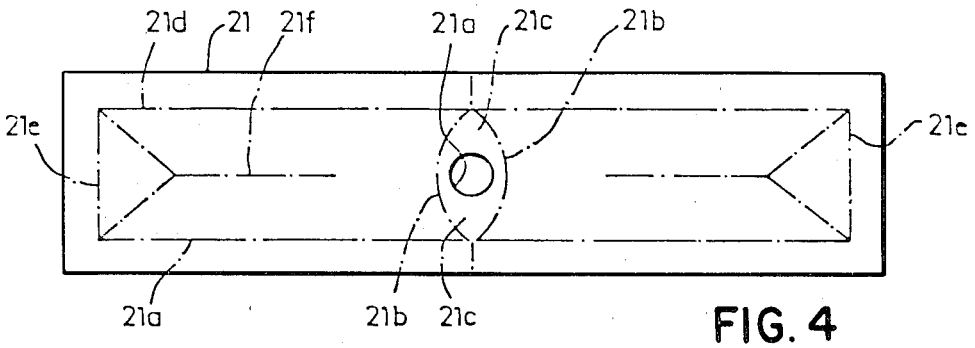
Figure 6:
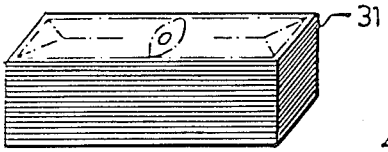
Figure 7:
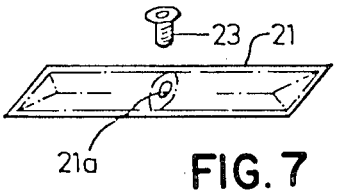
Figure 8:
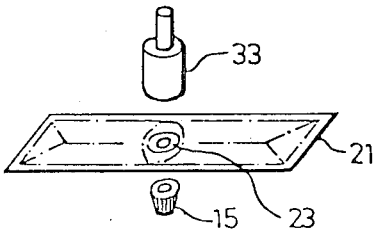
Figure 9:
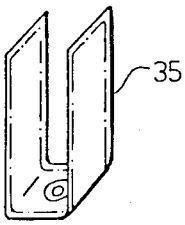
Figure 12:
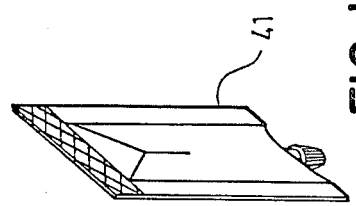
Figure 11:
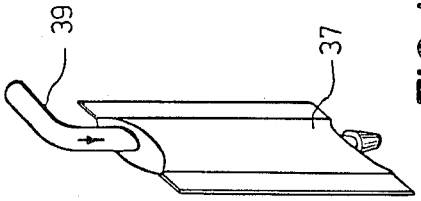
Figure 10:
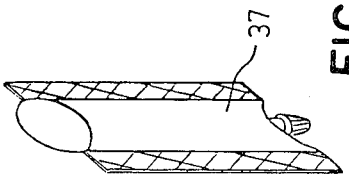
Figure 13:
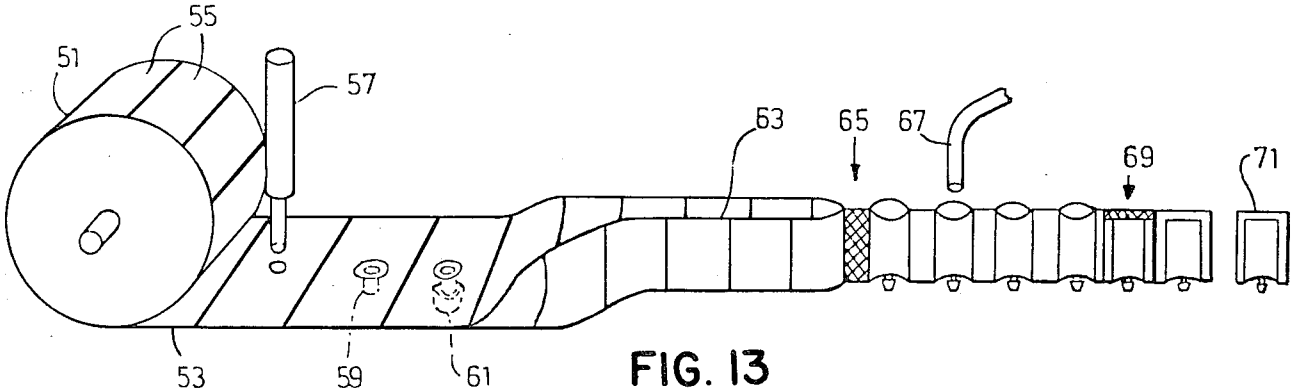
Figure 14:
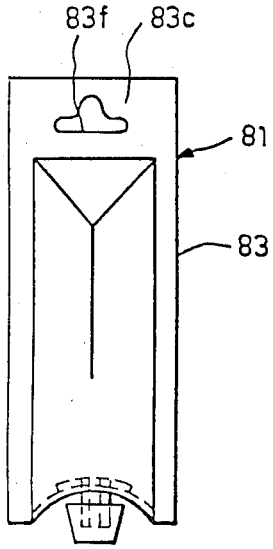
Figure 15:
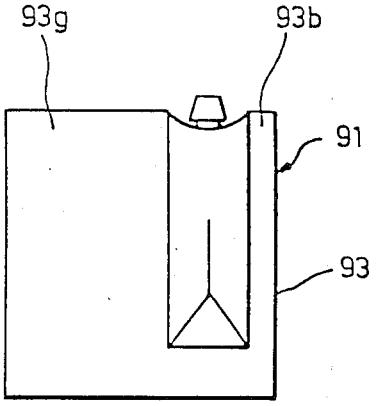
Figure 16:
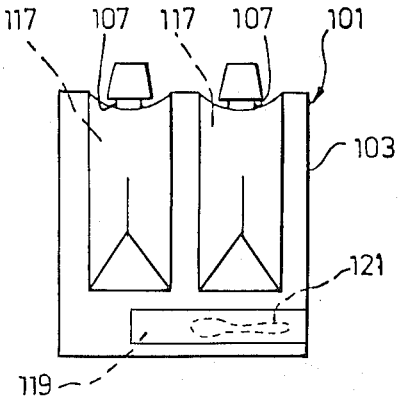
Figure 17:
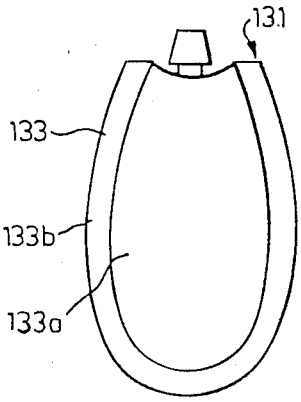

FIG. 2 a longitudinal sectional view through the container shown in FIG. 1, FIG. 3 a plan view on the discharge opening side end of the container, without the closing lid, FIG. 4 a plan view of a first blank which constitutes the first work piece for making a container, but at a reduced scale as shown in FIGS. 1–3, FIG. 5 a side view of the second blank which constitutes the second work piece for forming the discharge opening of the container, at a larger scale as shown in FIGS. 1 to 3, FIGS. 6 to 12 a schematic view of a sequence of operating steps for making a container out of two work pieces, showing in FIG. 6 a stack of blanks or first work pieces, respectively, FIG. 7 the insertion of a second work piece into a blank, FIG. 8 the fusing of the second work piece on the blank and the screwing on of a closing lid, FIG. 9 folding of the blank FIG. 10 fusing of the side edges of the blank FIG. 11 introducing a filler material into a container FIG. 12 fusing the end facing away from the discharge opening, FIG. 13 a schematic view of the operating process for making containers from a band material FIG. 14 a plan view on the broad side of a variant of a tubular container which is provided with a hole for hanging up the container, FIG. 15 a plan view of the broad side of a container which is provided with a flank for supporting an additional print FIG. 16 a plan view on the broad side of a variant with two containers joined into one body, and FIG. 17 a plan view on a container with a U-shaped contour.

The tube like deformable container 1, shown in FIGS. 1–3, is provided with a tubular body 3 and a front face 5 with a discharge opening 7. The longitudinal axis of the discharge opening 7 is designated with the numeral reference 9. The tubular body 3 is provided with two walls **3*a* which generally have a rectangular contour which are present at different sides of a symmetry plane 11 extending to the longitudinal axis 9, and which are symmetrically disposed to this symmetry plane 11 and individually perpendicular with respect to a symmetry plane 13 extending perpendicularly to plane 11 through axis 9. The center portions of the two walls 3*a* are provided with a plane strip-like edge segment 3*b* on each side facing away from the symmetry plane 13, and at the end facing away from the discharge opening a plane, strip like edge segment 3*c*. The three strip like edge segments 3*b*, 3*b* are attached without interruption at each of the two walls 3*a*. Otherwise, the edge segments of the two walls 3*a* are in a superimposed position and are tightly fused with respect to each other. As will be explained in detail, the two walls 3*a* are connected with a connecting center segment 3*d*** made of a unitary first work piece.

The front face 5 with discharge opening 7 is formed by the mentioned center segment **3*d* and a second work piece which is fused on the center segment. The center segment 3*d* with the sectional plane parallel to axis 9, as shown in FIG. 3, essentially has the form of a convex lens, whereby at both sides of plane 13 on acute angled corners of the lens, flank like edge segments 3*b* protrude. In the view shown in FIG. 1, and also accordingly in a sectional view through the symmetry plane 11, the center segments 3*d* is indented in such a manner that it extends from the edge portions 3*b* to its center toward the edge segment 3*c*. Therefore, the center support 3*d* is connected on both sides of the symmetry plane 11 by means of a folding edge 3*e* with each one of the two walls 3*a*. In the areas of the edges 3*b*, the two folding edges 3*c* on both sides of the symmetry plane 13** are joined into a single fold edge, disposed in the symmetry plane 11.

The discharge 7 is formed by the already mentioned second work piece and is provided with a cylindrical socket *7a* with an outer thread and a collar *7b*. The collar *7b* engages the face of the center segment *3d* facing to the inside of the container and is tightly fused thereto. The cross section of the collar *7b* is smaller than the smallest dimension of center segment *3d*, so that a strip of the outer segment is still available around the collar *7b* not covered by the collar, and that the discharge opening 7 overlaps only a portion of the face of the center segment, as shown in FIG. 3. A closing lid 15 may be screwed onto the socket *7a* with which the hollow space 17 is tightly closed against the outside.

The tube body 3 consists of a flat laminated material which is provided with a carton layer as the main component which is coated on the inside with a fusible thermoplastic material. A print with the name of the filler material and/or other information may be applied on the outside of walls *3a*.

The discharge opening 7 consists of a thermoplastic material which is fusible with the plastic coating of the tube body 3. The filler material defined for consumption in the hollow space is preferably a liquid or paste-like product. However, a powder-like material may be used as a filler material. For removal of the filler material, the closing lid 15 is removed and then the tube body 3 is compressed, preferably at edge segment *3c*. Since the tube body is easier to compress rectangularly with respect to the symmetry plane 11 than rectangularly with respect to the symmetry 13, the container must be necessarily so deformed during the removal of filler material that the compressed segments of each of the two walls *3a* assume a somewhat even plane. Therefore, if on the outer side of each wall *3a*, a text is imprinted thereon, this text remains effortless readable even when walls *3a* are compressed. The material which forms the tube body is elastically and, in particular plastically deformable in such a manner that the tube body substantially maintains its compressed shape, after a portion of the filler material has been pushed out therefrom, and after the person who compresses the tube releases the pressure therefrom. Therefore, practically no air is sucked into the hollow space 17 which could damage the filler material remaining in the tube, after the pressure release.

In the following, the making of the container 1 will be explained. At first, two separate types of work pieces namely a first work piece and a second work piece are made, for making the container 1.

One of the first work pieces is shown separately in FIG. 4 and designated 21. The first work piece 21 is a flat even blank and is of a rectangular shape. For making the first work piece, a carton material is coated with thermoplastic material at one side, printed on the other, and is then cut into the shape shown in FIG. 4. Furthermore, an opening *21a* is provided in the center of each piece 21, for example, by means of punching. Furthermore, notches may be provided along the dash-dot lines shown in the drawing, whereby these notches may be partially or completely omitted. The dash-dot lines limit various zones, in particular lines *21b* limit a segment *21c* which contains the opening *21a*. This segment has the shape of a lens disposed transverse to the longer rectangular side comprising two tips and forms the center segment *3d* at a later time. The lines *21d* which extend parallel to the larger rectangular sides through the two tips of the center segment *21c* and the lines *21e* which extend parallel to the shorter rectangular sides limit the edge portions *3b* and *3c* of walls *3a* when the container is finished. The notches which may extend along the Y-shaped lines *21f* facilitate the arching of walls *3a* during the subsequent folding of the blank.

One of the second work pieces is separately shown in FIG. 5 and designated 23. The second work pieces form the discharge opening 7 of the finished container and therefore are provided with a socket *23a* with an outer thread and a collar *23b*. The work piece 23 consists of a thermoplastic material and is disposed relatively symmetric with respect to axis 9. However, it should be pointed out that the collar 23 of work piece 23 extends exactly radially with respect to axis 9. The collar *23b* is elastically deformable, so that it still can be bent during the folding process to be described later, after it had been mounted on the center segment of a first work piece and thereafter assumes the curved position of the collar *7b*, shown in FIG. 1.

The first work pieces 21 are advantageously stored in stacks in their flat conditions and are transported to the filling station for introducing the filler material. Accordingly, the second work pieces 23 and the closing lids are transported to the filling station. Advantageously, the first and second work pieces and the closing lids are connected to tube like containers shortly before filling the filler material therein. This can be accomplished with the same cycle frequency as the filling operation and also with the same apparatus which performs the filling. The transport and the storing of the first and second work pieces and the closing lids requires a minimum of space in such an operational sequence.

The required operating steps for making and filling the container are shown in FIGS. 6 to 12.

First of all, a first work piece 21, i.e., a flat blank is mechanically removed from a stack 31, shown in FIG. 6. Furthermore, a second work piece is removed from a supply container, by means of a shaker conveyor. In the operating steps shown in FIG. 7, a second work piece 23 is inserted into the opening of the first work piece 21 at the side which is coated with plastic material. Thereafter, the collar of the second work piece is pressed against the first work piece which is mounted flat on a support, not shown, by means of a fusing tool 33 shown in FIG. 8, whereby the two work pieces are heated at the pressure location and are fused together. Simultaneously, during the forming of the second work piece, or shortly before, or after, a closing lid 15 is screwed onto the socket of the second work piece. In a subsequent operating step, shown in FIG. 9, the first work piece which had been connected with the second work piece is shaped into a U-shaped intermediary product 35. This deformation can be done in such a manner that the two U-shaped shanks are mounted with the U-shaped rib of center segment *21c* along parallel lines. In this case the deforming may be carried out in such a manner that at the two mentioned parallel lines no permanent bending locations are generated. However, the deformation can be such that the U-shaped shanks are connected along the lines *21d* and the U-shaped rib, thus being already convexly curved. In the operating step shown in FIG. 10 the side edges of the U-shaped shank are cross hatched for clearer identification, are pressed together with a suitable tool, and are fused together. Thereby, the intermediary product 37 is manufactured which substantially represents the finished container, but which is still open at the end facing away from the discharge end. So that the U-shaped shanks obtain their convex shape in FIG. 10 and have an opening of the already mentioned intermediary product 37, a core can be inserted between the two U-shaped shanks before fusing the side edges. Thereafter, through a filling line 39, shown in FIG. 11, a filler material is introduced into the intermediary product 37 from above. The filling line could be connected with the previously mentioned core and the filler material may be filled through this core, whereby the core during the filling is successively moved out of the intermediary product. In the operating step shown in FIG. 12, the edges of the two walls which are accentuated by the cross hatching and which face away from the discharge opening are fused with each other. Thereby, an end product 41 is obtained which corresponds to the container of FIGS. 1 to 3, but naturally is now filled.

In the aforementioned manufacturing method, the closing lids are only screwed onto the work pieces, after they are fused to the first work pieces. When the openings 21*a* are made large enough so that the closing lids can be pushed therethrough, the second work pieces with the already screwed on closing lids can then be fused onto the first work pieces.

In the manufacturing process shown in FIGS. 6 to 12, the tube bodies are made from work pieces 21 which, before the insertion and mounting of the second work pieces 23, which forms the discharge opening, are present in form of separate blanks. However, the tube bodies may be made out of a first work piece or from the band material which forms the first work pieces, whereby at a relatively advanced operating phase the first work pieces are separated from the band material. This manufacturing method is shown in a simplified manner in FIG. 13. Therein, a rotatably mounted supply drum 51 for a band 53 is shown. This band consists of the same laminated material as the work pieces 21, and is printed at one side, whereby equidistant successive transverse strips 55 are identically printed. Furthermore, notches may be punched into each transverse strip 55 which have the same disposition as already described in accordance with the first work pieces. The band 53 is wound off the supply roller 51 by the width of one transverse strip 55, through a cycled transport device in a stepwise manner. In a first operating station, an opening is punched into each transverse strip 55. A second work piece 59 is inserted into this opening in the following operating station and is thereafter fused therewith and provided with a closing lid 61. Thereafter, the band is deformed, so that a band segment 63 is generated which hs a U-shaped cross section transverse to the feeding direction. The cross hatched edges of two segments are fused together with two subsequent transverse strips 55 in an operating station 65. In the subsequent station, filler material is introduced through a filler line 67. In the operating station 69, the edge segments facing away from the discharge opening are fused together, whereby the visible edge of the two edge portions is again accentuated by a cross hatching. Only after this operating phase, pieces are cut off from the band each of which then forms a filled tube-like container 71.

It should also be noted that the two described methods of manufacturing may be combined in any given manner. Naturally, certain operations must be carried out on the band material, as shown in the left part of FIG. 13, thereafter pieces may be separated therefrom which at this point would be empty containers, but are merely intermediary products.

The container 81 shown in FIG. 14 differs from the container of FIG. 1 in that the edge segment 83*c* of the tube body 83 facing away from the discharge opening is wider than the edge segment 3*c* and is provided with an opening 83*f*. This enables one to hang the container 81 on a hook, or the like.

In the container 91, shown in FIG. 15, at least the one wall of the tube body 93 is enlarged at the one longitudinal side of the hollow space of the container, so that a flank 93*g* is provided, which is substantially wider than the opposite disposed edge segment 93*b* and forms an additional face provided with a print.

FIG. 16 shows a double container 101, whereby the tube body 103 limits two hollow spaces 117 with one each closeable discharge opening 107. The two hollow spaces 117 may contain the two different components of a two component bonding material. Furthermore, an open pocket 119 is provided at one side of the tube body 103 wherein an accessory 121, for example, a spatula for mixing and applying the adhesive may be accommodated. The tube body 103 is formed by two walls which are connected with each other by means of center segments and have two discharge openings, as described with the aforementioned various embodiments. However, in contrast to the aforementioned exemplified embodiments, the two hollow spaces 117 are not limited by fused edge portions at the sides facing each other, but by strip like fused intermediary segments.

The containers may also have a different shape, instead of a rectangular shape. For example, the tube body 133 of the container 131 shown in FIG. 17 has a U-shaped contour. The edges 133*b* of the walls 133*a* may be limited with U-shaped lines therein. However, the lines may form three sides of a rectangle, as shown in FIG. 1.

Furthermore, the dimensions and proportions of the container may varied very widely. For example, a container could be made containing a beverage having a very high volume. In such containers the center segments may have a correspondingly larger dimension with respect to the discharge opening, as is shown in FIG. 3 for example.

In the container 1, the center segment 3*d* is limited by folding edges 3*e* which are permanently arched, with the exception at the locations where the edges 3*b* start. However, it would also be possible to provide a center segment which in its plan view forms a polygon.

Normally, the discharge sockets are provided with an annular cross section in their openings for the filler material. However, the openings of the discharge sockets may have another discharge form or cross section. Thereby, when pushing paste like filler material out of the containers, paste strips having different configurations may be formed which in certain applications would be desirable, for example, decorating cakes.

Instead of a rectangular blank, as shown in FIG. 4, the tube body may be made from an arrow tip like shaped blank. From this, tube bodies could be made wherein the parallel side edges of the walls could be of different length.

Furthermore, the first work pieces or blanks may be made consisting completely of thermoplastic, fusible plastic material, instead of carton material coated with a plastic material.

What is claimed is:

1. A deformable container of semi-rigid material consisting of, a. a planar first work piece resistant to thermoplastic deformation with an at least one side having a fusible coating thereon, b. a shaped folding edge means defining a center segment with an opening therethrough, c. a first side wall segment transverse to the said center segment commencing at a section of the said shaped folding edge means and terminating at the periphery of the said first work piece furthest from the said shaped folding edge, d. a second side wall segment transverse to the said center segment commencing at a section of the said shaped folding edge symmetrically opposite that of the commencement of fold of the first side wall segment and terminating at the periphery of the said first work piece furthest from the said shaped folding edge from whence the second side wall segment commenced, e. said center segment disposed to controllably deflect the said first and second side wall segments into depressed cavities therein having an elevation following the shaped folding edge means and thereto fixedly separate the first side wall segment and second side wall segment proximately situated to the said shaped folding edge, f. side edge means on the periphery of the said first and second wall segments defining the depressed cavities therein and disposed to be fusibly mated to form a hollow space for filler material, g. closing edge means around the periphery of said mated side walls defined by the unfused portions of the said fused right and left side alls disposed to be fusibly mated after filling the said hollow space, h. a second work piece consisting of an extended collar means and a discharge opening means with a connecting means thereon projecting transversely from the said collar with a bore through the longitudinal axis of the said discharge opening means and extended collar means, said discharge opening means disposed to project through the said opening in the said central segment and said collar means to be fusibly connected to the said fusible coating, and i. a closing lid means operatively associated with the said connecting means on the said discharge opening means to stop discharge of the filler material.

2. In the deformable container as claimed in claim 1 wherein the said shaped folding edge defining the said center segment is a pair of symmetrical arcs intersecting on an axis through the said center segment dividing the said planar first work piece into symmetrical halves, said arcs intersecting within the periphery of the planar first work piece.

3. In the deformable container as claimed in claim 2, wherein the width of the said side edge means is equal to the length of the segment between the point of the intersecting arcs on the axis through the said central segment and the periphery of the said side walls.

4. In the deformable container as claimed in claim 2 wherein the central segment is a pair of ungulas placed base to base defined by the intersection of the planes generated by the intersecting arcs after mating of the said right and left side wall segments and a cylindrical section whose radius is located on the longitudinal axis of the second work piece and whose wall is generally traverse to the said side wall segments, said ungulas resulting from the non-thermoplastic deformation of the first work piece along the symmetrically shaped folding edge means.

5. A deformable container for controllably dispensing filler material consisting of, a. a tubular body formed of a unitary first work piece of uniformly thick semi-rigid sheet material resistant to thermoplastic deformation having an inner surface with a fusible coating thereon and an outer surface, a periphery having a near edge and a far edge, and a right side wall segment with a right edge and a left side wall segment with a left edge, b. a center segment with an opening therein enclosed within a perimeter on an axis through the said central segment of predetermined shaped folding edge means disposed at predetermined locations on the said outer surface of the said sheet material, said central segment forming a transverse wall to separate the said right and left side walls, c. said right side wall segment generally traverse to the said center segment commencing generally at a right side wall segment of the said shaped folding edge means and bounded by the said right edge, said right wall segment having a hollow space depressed in the inner surface thereof, and having an elevation following the contour of the said transverse center segment, d. said left side wall segment generally traverse to the said center segment commencing generally at a left side wall segment of the said shaped folding edge means and bounded by the said left edge, said left side wall segment having a hollow space depressed in the inner surface therein in mirror image to the said hollow space in the said right side wall segment, and disposed to be mated to the said right side all segment, and having an elevation following the contour of the said shaped folding edge means, e. a near edge fold line commencing at a point on the said perimeter of shaped folding edge means proximately situated to the near edge and running in a line to a predetermined point on the near edge, f. a far edge fold line commencing at a point on the said perimeter of shaped folding edge means proximately situated to the far edge and running in a line to a predetermined point on the far edge, g. a strip like edge segment means disposed for mating the said right side wall segment to the said left side wall segment commencing at the near edge fold line and thence generally following the periphery of the said sheet material to terminate at the oppositely situated far edge fold line, enclosing the hollow spaced in the said right and left side wall segments thereby, h. a discharge opening formed of a second work piece having a collar with an upper surface thereon and cylindrical socket with connecting means thereon traversely projected from the said collar and a bore through the longitudinal axis thereof, i. said cylindrical socket having an outer diameter slightly smaller then the said opening of the said central segment to effectuate passage through the said opening in the said central segment and said collar having a diameter greater than the diameter of the said opening but less than the width of the said central segment at the predetermined location of the opening and disposed to be fusibly connected to the said inner surface of the said central segment, j. a closing lid means with a bore partially therethrough the longitudinal axis fitted for cooperative connection and reconnection with the said connecting means on the said cylindrical socket.

6. In the deformable container as claimed in claim 5 wherein the central segment follows the shape of a convex curve defined by fold lines of intersecting arcs and having the said opening at the axial center thereof.

7. In the deformable container as claimed in claim 5 wherein the strip like edge segment means has an opening traversely therethrough for cooperative engagement with a hanging means.

8. In the deformable container as claimed in claim 5 wherein the strip like edge segment means has an at least one enclosed isolated cavity formed therein.

9. In the deformable container as claimed in claim 5 wherein the said side wall segments are generally rectangular in shape.

* * * * *